US012239237B2

(12) United States Patent
Bodnar et al.

(10) Patent No.: US 12,239,237 B2
(45) Date of Patent: Mar. 4, 2025

(54) NON-UPHOLSTERED ERGONOMIC SEAT WITH ANATOMICAL PROPERTIES FOR MAXIMUM COMFORT

(71) Applicant: Black Special Systems Sp. z o.o., Wroclaw (PL)

(72) Inventors: Bartosz Bodnar, Jozefoslaw (PL); Katarzyna Warzecha, Jozefoslaw (PL); Waclaw Niedzielski, Piaseczno (PL); Maciej Bodnar, Wroclaw (PL); Filip Olenderek, Wroclaw (PL)

(73) Assignee: INVENTRA Sp. z o.o., Warsaw (PL)

( * ) Notice: Subject to any disclaimer, the term of this patent is extended or adjusted under 35 U.S.C. 154(b) by 42 days.

(21) Appl. No.: 18/246,579

(22) PCT Filed: Sep. 28, 2021

(86) PCT No.: PCT/PL2021/000072
§ 371 (c)(1),
(2) Date: Mar. 24, 2023

(87) PCT Pub. No.: WO2022/075867
PCT Pub. Date: Apr. 14, 2022

(65) Prior Publication Data

US 2023/0414000 A1 Dec. 28, 2023

(30) Foreign Application Priority Data

Oct. 5, 2020 (PL) ..... 435589

(51) Int. Cl.
*A47C 7/02* (2006.01)
*A47C 7/46* (2006.01)

(52) U.S. Cl.
CPC ..... *A47C 7/021* (2013.01); *A47C 7/029* (2018.08); *A47C 7/46* (2013.01)

(58) Field of Classification Search
CPC ..... A47C 7/029
(Continued)

(56) References Cited

U.S. PATENT DOCUMENTS 2,933,738 A * 4/1960 Whelan ..... A47C 20/027 5/630
3,158,878 A * 12/1964 Pernell ..... A61G 7/05723 128/889
(Continued)

FOREIGN PATENT DOCUMENTS

CA 2545963 A1 11/2006
CN 2905927 Y 5/2007
(Continued)

OTHER PUBLICATIONS

International Search Report issued in International Application No. PCT/PL2021/000072 (Jan. 31, 2022).

*Primary Examiner* — Rodney B White
(74) *Attorney, Agent, or Firm* — McBee Moore & Vanik IP, LLC

(57) ABSTRACT

A seat is configured to be mounted on chairs, benches with seats, stadium seats, and toilet seats. Characteristic for the seat is that an upper surface 1 of the seat is variously shaped such that from the side of a rear edge 2 it slopes downwards, following an arc, towards a front edge 3 of the seat and the upper surface 2 has rear recesses 4, central recesses 5, front recesses 6, and side recesses 7 arranged thereon, symmetrically in relation to the longitudinal symmetry axis of the seat, where all of which are located within a profiled ergonomic niche 8 with a shape similar to the letter H, while transverse arm 9 of the profiled ergonomic niche 8 connects longitudinal arms 10 of the profiled ergonomic niche 8 forming a relief groove. The rear recesses 4, central recesses 5, and front recesses 6 have different length and depth, and have an ellipsoidal shape; they are arranged one after the
(Continued)

other along the longitudinal arm 10 of the profiled ergonomic niche 8, and the side recesses 7 are arranged between the central recesses 5 and front recesses 6 and side edges 11 of the seat.

15 Claims, 7 Drawing Sheets

(58) Field of Classification Search
USPC ..... 297/452.21, 452.26
See application file for complete search history.

(56) References Cited

U.S. PATENT DOCUMENTS 3,376,070 A 4/1968 Johnson
3,503,649 A * 3/1970 Johnson ..... A47C 7/18 297/452.26 X
3,749,442 A * 7/1973 Berg ..... A47C 7/14 297/312
5,163,737 A 11/1992 Navach et al.
5,294,181 A * 3/1994 Rose ..... A61G 5/1045 297/452.57
5,395,162 A 3/1995 Jay et al.
5,657,499 A * 8/1997 Vaughn ..... A61G 7/057 297/284.6
5,833,319 A * 11/1998 Davis ..... A47C 7/425 297/452.21 X
6,990,744 B2 * 1/2006 Bieganek ..... A47C 31/126 33/515
7,216,388 B2 * 5/2007 Bieganek ..... A47C 7/029 297/452.26 X
7,914,081 B1 * 3/2011 Smith ..... A61G 5/1045 297/452.21 X

FOREIGN PATENT DOCUMENTS

DE 102015100810 A1 * 7/2016 ..... A47C 7/029
EP 3047757 A1 7/2016
KR 101461336 B1 11/2014
PL 240761 B1 5/2022

* cited by examiner

G-G1 SECTION

G-G SECTION

NON-UPHOLSTERED ERGONOMIC SEAT WITH ANATOMICAL PROPERTIES FOR MAXIMUM COMFORT

CROSS-REFERENCE TO RELATED APPLICATIONS

This application is a National Stage entry of International Application No. PCT/PL2021/000072, filed Sep. 28, 2021, which claims priority to Polish Patent Application No. P.435589, filed Oct. 5, 2020.

BACKGROUND

Field

The subject of this invention is a seat intended to be mounted on chairs, benches with seats, stadium seats, and for use as toilet seats. The seat is profiled in a way that allows the proper positioning and support of the sitting person.

Description of Related Art

It has always been a problem to combine the comfort of sitting with the stiffness of the surface resulting from use in public places such as communication, waiting rooms, medical facilities, schools, the military, etc. To make the seat surface easy to wash and durable, materials such as plywood, plastics or metal are usually used, as is the case with the iconic military American chair from 1940. Stiff seats, of course, are also used in dwelling places on a daily basis, which is favoured by modern design. However, prolonged contact with such a stiff surface causes discomfort, which most often ends with the user's poor sitting position. This is mainly due to the non-adaptation and/or lack of an appropriate shape of the seat surface in relation to human anatomical shapes. Taking into account the human anatomical structure, it must be remembered that, when sitting, she/he rests mainly on the ischial bone with concomitant support of the lower surface of the thighs.

Known in the prior art is a seating system for wheelchairs and other applications described in U.S. Pat. No. 5,395,162. The seating system includes a base member with an upper surface and a fluid pad positioned on the upper surface. The upper surface is preferably profiled and dimensioned to have areas corresponding to the user's ischial tuberosities and coccyx as well as the user's femurs including the trochanters. In the preferred embodiment, the fluid pad is in one piece and has at least three separate and distinct pouches filled with fluid. Each pouch includes seals to contain the fluid in each pouch, and to isolate and prevent fluid communication with the fluid in the other two pouches. Each pouch of the pad is then respectively positioned on the upper surface of the base member under the user's ischial tuberosities and coccyx. In this manner, each of the user's ischial tuberosities and coccyx is supported on the separate and distinct fluid pouch. The use of the above-mentioned solution creates a problem resulting from long-term use of convex surfaces with a fluid that tightly adheres to the surface of the user's buttocks, which causes the possibility of circulatory disturbance. Moreover, significant decrease of the surface towards the inside of the seating system, combined with flexibility and significant lowering, causes internal rotation of the femur and raises the trochanter of the femur, which is unfavourable for physiological reasons. In this solution, the mutual position of the pelvis and the trochanter of the femur is variable, depending on the flexibility of the material used for the seating system cover, and is dependent on the weight of the user, and therefore does not guarantee a stable, proper positioning of the pelvis and the femurs.

Another prior art publication CA 2 545 963 discloses a seat cushion with an adjustable shape and a method of adjusting the shape of the seat cushion. A flexible support structure of a seat cushion, such as a wheelchair cushion, has an upper surface with a support contour having relief areas for establishing relatively less pressure on skin adjacent to bony prominences of the user's pelvis and having a support area for establishing relatively more pressure on skin covering a tissue mass spaced from the bony prominences. The profiled seat cushion has a support structure made of flexible material, the support structure generally including opposite front and rear sides, generally opposite left and right sides, a bottom surface extending between the front and rear sides and between the left and right sides, and a top surface generally opposite to the bottom surface and extending between the front and rear sides and between the left and right sides; the top surface formed as a support contour defining relief and support areas, the relief areas positioned to align with the bony prominences of the person sitting on the cushion, and the support areas positioned to align with tissue masses of a posterior lateral buttocks tissue; an insertion member; and openings in each of the rear corners between the top surface and the bottom surface of the support structure to receive the insertion members, the openings positioned between the top surface and the bottom surface, and the support area changing the position of the support contour with respect to the other support areas or relief areas, after the insertion member has been inserted into one of the openings. A slit is formed in the rear corner of the support structure, and the member is inserted into the slit to adjust the position of the support area thereby adapting the support contour for better support of the pelvic area. The cover encases the support structure to resist outward deformation of the support structure. The cover includes an expansion portion that expands the cover at the rear corner thereby increasing the size of the cover to encase the increased dimension of the corner due to insertion of the insertion member. This publication shows the shape of the surfaces which cause the long axis of the spine and the axis of the thigh to form an acute angle, which is unfavourable for the spine. In addition, the protrusion may affect the formation of pressure within the sciatic foramen, where the sciatic nerve and the pear-shaped muscle (*piriformis*) are located. The presented wedge, when inserted into the right place, increases the pressure on the trochanter and may change its position. The sealing pressure makes it possible to improve stabilization, but at the same time, it prevents micro-movements. According to this disclosure, when sitting, the gluteal muscles move apart and the ischial tuberosities contact with the seat cushion surface by the pressure of the skin. Soreness after prolonged sitting is a problem to be solved.

Another prior art solution is the publication U.S. Pat. No. 3,376,070 describing a shaped seat cushion. This cushion is adapted to be used on a seat in order to properly support the weight of a person sitting thereon. The cushion includes: a U-shaped recess therein opening toward the forward edge thereof for receiving and supporting the posterior of the upper thighs of a person sitting on the cushion; a pelvic support to support the posterior upper iliac (lumbar) vertebrae of a person sitting on the cushion, means for engaging and supporting the tuberosities (protuberances) of the ischial bones that include a pair of elongated, longitudinally curved ridges positioned on the rear side of the said U-shaped recess. The cushion also has means for engaging and supporting the tuberosities (bumps) of the ischial bones that include a pair of elongated, longitudinally curved ridges positioned on the rear side of the said U-shaped recess. According to the publication, the support of the pelvis positions the spine into kyphosis. In the light of the current medical knowledge, this position is conducive to form posterolateral discopathies, especially at the L4-L5 and L5-S1 levels.

In order to achieve the user's comfort, the above-mentioned solutions use pads or flexible bases of the seats. These types of design are difficult to wash and prevent thorough disinfection.

Moreover, known from the Polish patent application description P.432983 is an ergonomic hygienic pad, especially for a toilet seat. The pad includes: an upper surface of the pad sloping towards the front part of the pad, elongated recesses arranged on the upper surface of the pad, and a centrally located hole. The recesses are arranged on the upper surface, in the middle and rear part of the pad, and in the rear part, the recesses overlap the rear support. The recesses have different depths in length and width, and are arranged opposite to each other in relation to the hole, from the side edge of the hole towards the outer side edges over a part of the width of the pad. The recesses extend from the front part of the hole to the rear part of the hole, and they follow a curve with the maximum recess located at the point corresponding to the ischial tuberosities of the pad user. The upper surfaces in the front part are flat and inclined in relation to the bottom surface at an angle ranging from more than 14° to 50°, and have extended thigh-supporting surfaces.

In the previous solutions, the difference in height between the lowest point of the ischial tuberosity surface and the femur during flexion in the hip joint has not been sufficiently taken into account. This difference in height, according to the knowledge of the Inventors of the present solution, is of great importance for maintaining the appropriate anatomical positioning of the pelvis and the femur. While sitting, the femur rotates automatically and the position of the trochanter of the femur changes, which in turn leads to a disturbance of the tone, and thus the function of the soft tissues. The specificity of the structure of the ischial bone was also not sufficiently taken into account. Most often, this led to excessive pressure on individual parts of the body resulting from the disproportionate distribution of the pressure of the body weight of the user.

For the appropriate way of sitting, especially for young people of school age, the problem is the proper positioning of the pelvis and the compatible, free creation of spine curvatures. An additional problem is the coexisting hypermobility of paraspinal tissues at a young age. Therefore, it is important to create a structure that will not only ensure the proper positioning of the pelvis, but also will properly affect the spine curvatures.

SUMMARY

The Inventors decided to solve the problem of sitting comfort on the seat by developing such a shape that eliminates inconveniences of the solutions from the state of the art. At the same time, the objective was to develop a seat that would ensure hygiene and easy disinfection of the surface.

From the medical point of view, the problem to be solved by the Inventors was to develop a shape of the seat so that a user, when using the seat, would adopt a position with physiological lumbar lordosis, as a result of which, the sitting comfort would be achieved while maintaining ergonomic compatibility.

With a view of eliminating the problems of proper positioning of the pelvis and the spine, the Inventors decided to elaborate a developed version of the invention that includes, apart from the seat, a backrest.

Characteristic for the seat according to the invention is that the upper surface of the seat is variously shaped such that from the side of the rear edge it slopes downwards, following an arc, towards the front edge of the seat, and the upper surface has rear recesses, central recesses, front recesses, and side recesses arranged thereon, symmetrically in relation to the longitudinal symmetry axis of the seat, where all of which are located within a profiled ergonomic niche with a shape similar to the letter H, while the transverse arm of the profiled ergonomic niche connects the longitudinal arms 10 of the profiled ergonomic niche forming a relief groove. The rear recesses, central recesses, and front recesses have different length and depth, and have an ellipsoidal shape; they are arranged one after the other along the longitudinal arm of the profiled ergonomic niche, and the side recesses are arranged between the central recesses and front recesses and the side edges of the seat.

Preferably, the rear recesses, central recesses, and front recesses are situated at angles in relation to the longitudinal symmetry axis of the seat; the rear recesses and rear parts of the central recesses are situated at one angle, and the front parts of the central recesses and the front recesses are situated at another angle, and the said angle increases from the place of the deepest central recess towards the front edge of the seat.

Preferably, the upper surface of the seat, from the rear recesses, central recesses, and front recesses towards the side edges, forms bulges which decrease in height from the side of the rear edge towards the front edge; and in the front part from the side of the front edge, the seat surface is flat.

Preferably, the side recesses are located on the bulges of the upper surface of the seat, which are situated approximately halfway across the bulges, between the side edges and the longitudinal arm of the profiled ergonomic niche. Preferably, the side recesses have longer axes arranged at an angle in relation to the longitudinal arms of the profiled ergonomic niche.

At the same time, preferably, the rear recesses and central recesses, from the side of the rear edge to the place of the deepest central recess, are situated at an angle in the range of 8-14 degrees, preferably 12 degrees; and from the place of the deepest central recess through the front recesses towards the front edge, they are situated at an angle in the range of 20-16 degrees, preferably 18 degrees.

Preferably, the central recesses have their centres of the greatest depth situated at approximately ⅓ of the length of the seat from its rear edge 2, respectively.

Preferably, the side recesses are situated at approximately ⅖ of the length of the seat from its rear edge and at approximately 1/10 of the width of the seat from its side edge, respectively.

Preferably, the seat has a centrally located pear-shaped opening, which has a taper in the front part of the seat. The opening partially overlaps the part of the central recess and the relief groove. This solution serves as a pad or a toilet seat.

Preferably, when the rear recesses, central recesses, front recesses, and side recesses are arranged such that drawing a line through the deepest central recess and the farthest point towards the front edge of the front recess forms an ascending line, and drawing a line through the side recess and the farthest point towards the front edge of the front recess forms a descending line. These lines intersect to form a flattened letter X.

The seat according to the invention is a seat part of chairs; it can be used to make benches with seats, stadium seats, and toilet seats.

Moreover, it is preferred when the seat comprises a lumbar support which is connected to the seat via a bracket attached to the bottom surface of the seat and to the rear surface of the lumbar support. The lumbar support is an element having a substantially flat rectangular back and a profiled contact part having a recessed central part and side surfaces obliquely situated in relation to the recessed central part, wherein the surface of the recessed central part and the obliquely situated side surfaces are convex, and between the recessed central part and the obliquely situated side surfaces, there are arranged concave triangular surfaces.

Preferably, the profiled contact part of the lumbar support is bulged along the radius R 25° along its longer symmetry axis, the profiled recessed central part is half the width of the lumbar support, and the remaining width of the backrest is formed by two obliquely situated side surfaces. Along the side edges of the profiled recessed central part in the direction of the long axis, there are substantially triangular recesses with a radius R 100° and a width at the base of the triangle in the range of 15-25 mm, preferably 20 mm, the apices of which meet at half the height of the backrest at the height of the longer axis of symmetry. Profiled side surfaces extend from the edge of the concave triangular surfaces towards the outer side edge of the lumbar support, and their inclination angle $\alpha$ is in the range of 20-30°, preferably 24°, and the length of these side surfaces is in the range of 55-75 mm, preferably 65 mm.

At the same time, the seat according to the invention is made of materials that are easy to disinfect, preferably of wood-based materials, plastics, or metals.

Appropriate spine curvature is a function of the angular position of the pelvis, as determined by the Whitman-Ferguson's angle. If a seat surface does not correspond to the characteristic anatomical shapes of the pelvis and the femurs, then users of the seat most often adopt poor posture in search of comfort. The Inventors of the described solution, thanks to the subject solution, created a precisely shaped surface of the seat, thereby achieving comfort of sitting and appropriate spine curvature, especially in lumbar section. The comfort of sitting results from the anatomically proper positioning of the pelvis and the femurs. In addition, thanks to a variant solution, which additionally uses a lumbar support, the impact on the proper spine positioning has been increased.

The solution according to the invention ensures maximum comfort and compliance with hygiene rules while maintaining full ergonomics, and eliminating upholstery and other types of materials that make the seat soft.

In the present invention, the appropriate shape of the upper surface of the seat has been used with appropriately spaced recesses, which in an innovative way relieve ischial tuberosities (tuber ischiadica) as well as the area of the ischial spine (spina ischiadica), and also relieve the ramus of the ischial bone (ramus ossis ischii). Very important and innovative is the arrangement of the side recesses that support the area of the greater trochanter (trochanter major), preventing thigh rotation. Equally important is the groove formed by the recess at the point where the sciatic nerve is located, relieving the posterior surface of the thigh. At the same time, the ascending configuration of the back of the seat surface keeps the pelvis at the appropriate angle of inclination.

BRIEF DESCRIPTION OF THE DRAWINGS

The subject of the invention will be explained in more detail by the exemplary embodiment shown in the illustrative drawing in which it is shown.

Figure 1:
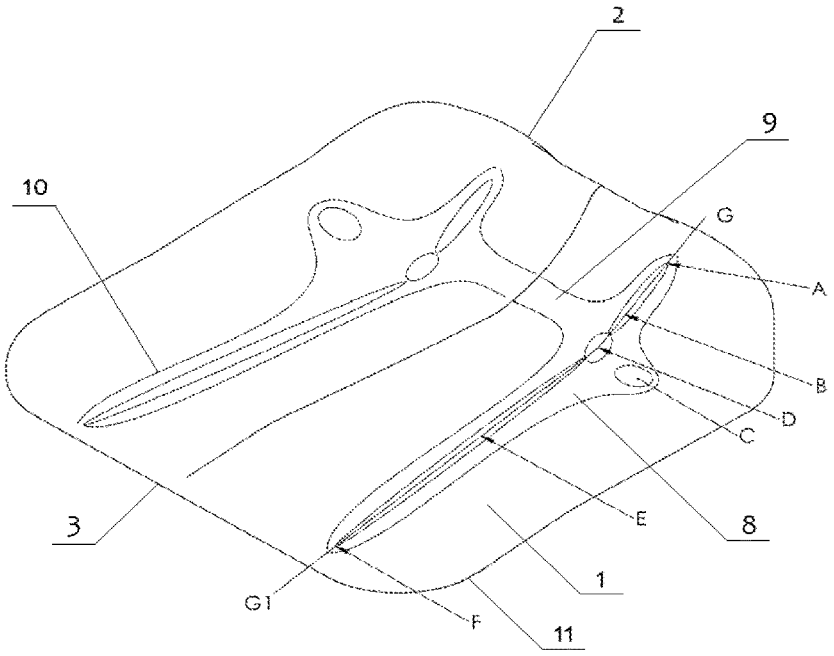
FIG. 1—a schematic perspective top view of the seat, in one variant of the embodiment, showing the ergonomic niche with an illustration of the arrangement of characteristic recesses in its contour, FIG. 2—a schematic top view of the seat, in one variant of the embodiment, in which levels are used to show the direction of the depth changes in the recesses within the ergonomic niche, taking into account their distinct position and function, FIG. 3—a sequence of the sectional views along the H-H, J-J, K-K, L-L lines of the seat, in one variant of the embodiment, shown in FIG. 2, FIG. 4—a schematic illustration of a part of the seat, in one variant of the embodiment, in a top view and sectional view along the G-G1 line, FIG. 5—a schematic illustration of the seat, in one variant of the embodiment, showing lines forming a flattened X mark, FIG. 6—a schematic perspective top view of the seat, in a further variant of the embodiment, showing the ergonomic niche with an illustration of the arrangement of characteristic recesses in its contour, FIG. 7—a schematic illustration of a part of the seat, in a further variant of the embodiment, in a top view and sectional view along the G-G1 line, FIG. 8—a schematic perspective top view of the seat, in a further variant of the embodiment including a lumbar support, FIG. 9—a schematic perspective top view of the bracket to which the seat and the lumbar support are attached, FIG. 10—views of the lumbar support in a front view, side view, top view, sectional view, and in perspective.
Figure 2:
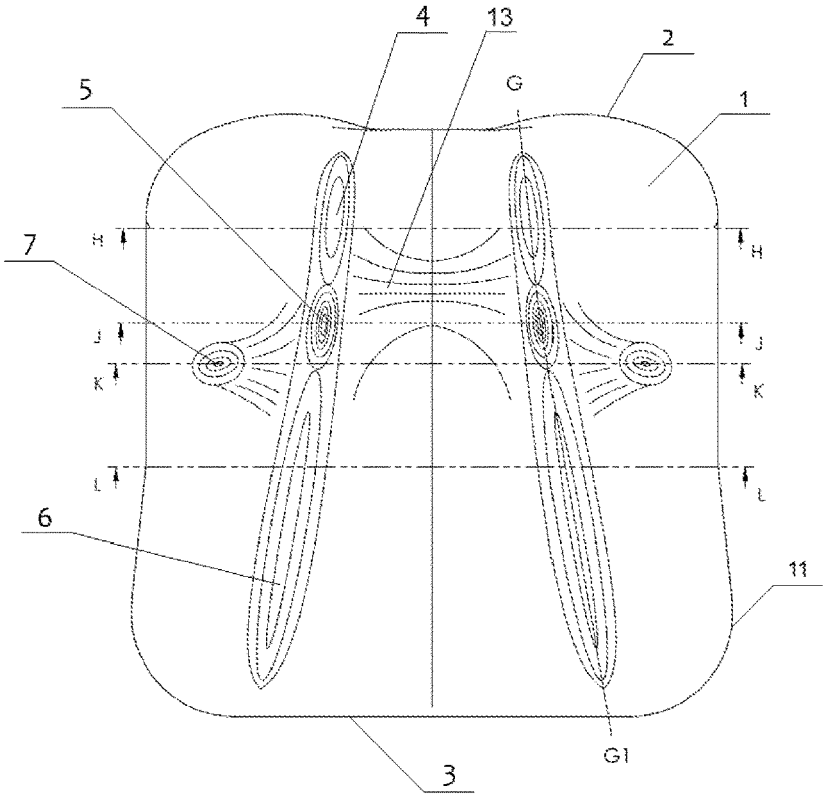
Figure 3:
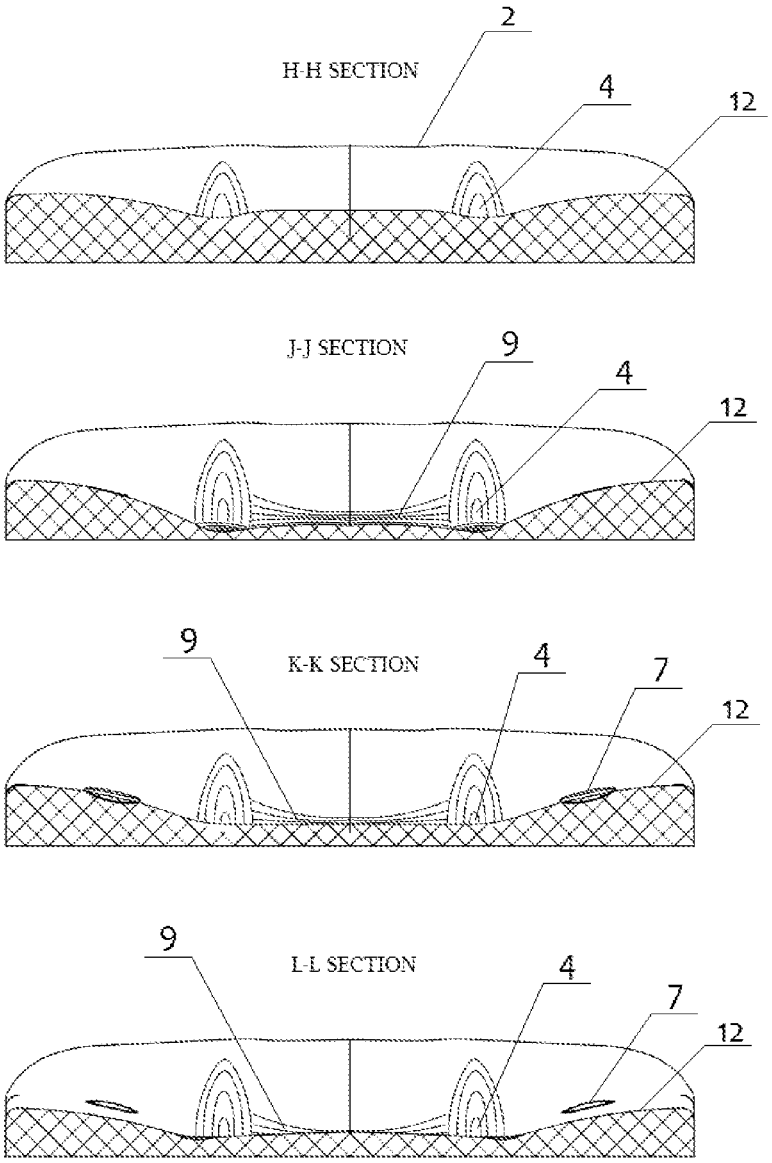
Figure 4:
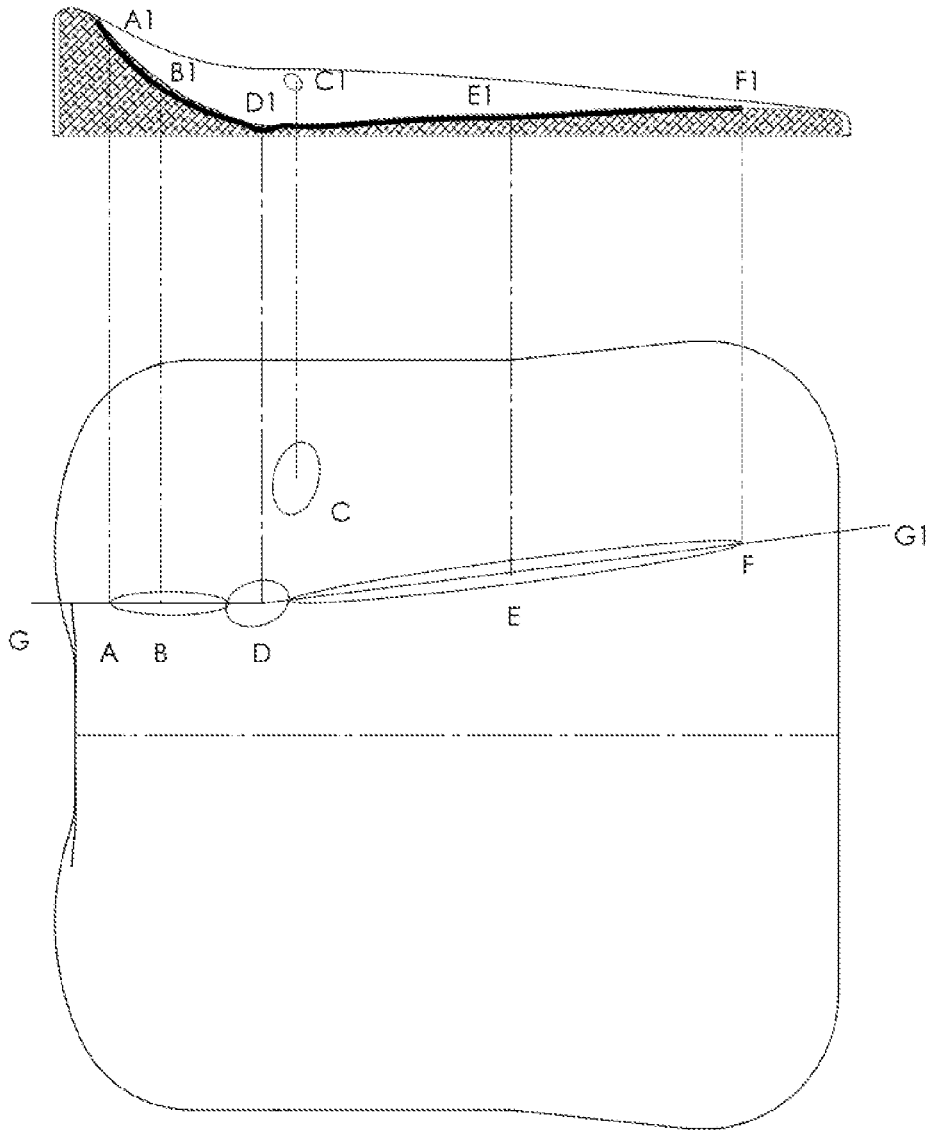
Figure 5:
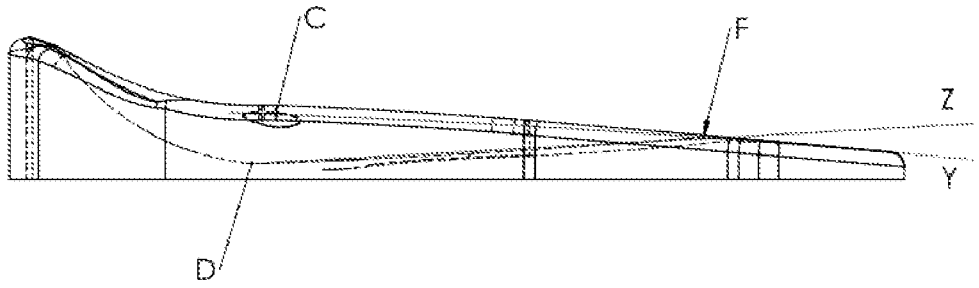

For a better understanding of the invention, it is presented in more detail in the following embodiments, which are only illustrative examples and are not intended to limit the invention.

DETAILED DESCRIPTION OF A PREFERRED EMBODIMENT

The arrangement of the recesses in the following implementations takes into account dimensions of adult human pelvis, developed on the basis of generally available graphs of percentile grids. In other implementations, the seats have individual angles of inclination and recesses, taking into account dimensions appropriate for population of children and adolescents. However, regardless of the final dimensions in the individual embodiments, the proportions of the shape of the upper surface of the seat, as well as the arrangement and the shape of the recesses comply with the scope of the desired protection as defined by the appended claims.

In the present exemplary embodiments, the seat shapes have been made on the basis of the available databases analysis in terms of dimensions characteristic for given age groups.

The applicable EU standards, for example for school furniture, were also included.

In the exemplary implementation shown in the accompanying drawings FIGS. 1-5, the seat is intended for adults, so its dimensions are selected to match the statistically determined sizes.

In this form, the seat has a profiled upper surface with recesses and inclinations in a part of the upper surface. The upper surface 1 of the seat is variously shaped such that from the side of the rear edge 2 it slopes downwards towards the front edge 3 of the seat. This slope runs gently, following an arc, supporting pelvic muscles, particularly gluteal muscles, which in turn increases the effect of the pelvic bones relief. At the same time, the profiling of the back of the seat helps to maintain the proper angular position of the pelvis, which can be easily verified by measuring the Whitman-Ferguson's angle. The rear part of the seat has a rounded apex, the maximum height of which corresponds to approximately 1/6 of the length of the seat. An arc-like slope extends from the apex of the rear edge of the seat to the edge from the rear side of the central recess 5 which is situated at approximately 1/10 of the height of the seat.

On the upper surface 1, there are arranged, symmetrically in relation to the longitudinal symmetry axis of the seat, rear recesses 4 to position the ramus of the ischial bone, central recesses 5 to position the ischial tuberosities, front recesses 6 to position the sciatic nerves, and side recesses 7 to relieve the trochanter of the femur. All recesses are placed within the profiled ergonomic niche 8 with a shape similar to the letter H. The transverse arm 9 of the profiled ergonomic niche 8 connects the longitudinal arms 10 of the profiled ergonomic niche 8 forming a relief groove 13. The rear recesses 4, central recesses 5, and front recesses 6 have different length and depth, and have an ellipsoidal shape; they are arranged one after the other along the longitudinal arm 10 of the profiled ergonomic niche 8. The rear recesses 4 are arranged on an inclination, following the arc of the rear part, and have the shape of an elongated ellipse with the maximum length close to the height of the apex of the rear part, while the maximum width of this recess is about 1/5 of its length, while the rear recesses 4 have the greatest depth in their central part. The rear recesses 4 are approximately twice as long as the central recesses 5.

In this embodiment, the longer axes of the ellipsoidal rear recesses 4, central recesses 5, and front recesses 6 extend along the length of the seat, with the rear recesses 4 extending over about 1/5 of the length of the seat, the central recesses 5 extending over about 1/7 of the length of the seat, and the front recesses 6 extending over about 3/5 of the length of the seat. The longer axes of the ellipsoidal side recesses 7 are arranged at an angle in relation to the longitudinal arms 10 of the profiled ergonomic niche 8.

The central recesses 5 are the deepest ones, and they are situated 15 cm from the rear edge 2 of the seat and 12.5 cm from the side edge 11 of the seat. The side recesses 7 are situated between the central recesses 5 and front recesses 6 and the side edges 11 of the seat; and in this embodiment, they are located 11.5 cm from the rear edge 2 of the seat and 5.5 cm from the side edge 11. The central recesses 5 are situated at about 2/7 of the length of the seat from its rear edge 2 and at about 1/7 of the width of the seat from its side edge 11, respectively.

The deepest points of individual recesses are located centrally in individual recesses.

If a line was drawn between the apex of the rear edge 2 and the foremost point of the seat, then in this exemplary embodiment, the deepest point of the rear recess 4 is situated 37 mm from this hypothetical line, the deepest point of the central recess 5 is situated 45 mm from this line, the deepest point of the front recess 6 is situated 26 mm from this line, and the deepest point of the side recess 7 is situated 23 mm from this line.

At the same time, the rear recesses 4, central recesses 5, and front recesses 6 are arranged one after the other in a line, and are situated at an angle in relation to the longitudinal symmetry axis of the seat, and this angle is variable along the length. From the side of the rear edge 2 to the point of the deepest central recess 5, this angle is 12 degrees, and from the point of the deepest central recess 5 through the front recesses 6 towards the front edge 3, the said angle is 18 degrees. The different angles between the longitudinal recesses 4 and the recesses 6 position the pelvis as favourably as possible, for greater comfort of use. Moreover, an obtuse angle between the front recesses 6 allows the relaxation of the ligamentous-capsular system of the hip joints as well as for the intermediate positioning of the sacroiliac joints, in which, in the sitting position, there is a tendency to excessive nutation of the sacrum.

The upper surface 1 of the seat, from the rear recesses 4, central recesses 5, and front recesses 6 towards the side edges, forms bulges 12 which decrease in height from the rear edge 2 towards the front edge 3; and in the front part from the side of the front edge 3, the seat surface 1 is flat.

The side recesses 7 are located on the bulges 12 of the upper surface 1 of the seat, which are situated halfway across the bulges 12, between the side edges and the longitudinal arm of the profiled ergonomic niche.

In this embodiment, the profiled ergonomic niche has a contour with a shape similar to the letter H which encompasses all the recesses.

In addition, the rear recesses 4, central recesses 5, front recesses 6, and side recesses 7 are arranged such that drawing a line through the deepest central recess 5 and the farthest point towards the front edge 3 of the front recess 6 forms an ascending line, and drawing a line through the side recess 7 and the farthest point towards the front edge 3 of the front recess 6 forms a descending line; the lines intersect to form a flattened letter X.

According to the problem to be solved, the subject seat is made of materials that are easy to disinfect. In this implementation embodiment, it is made of wood-based materials, but in other embodiments, the seat is made of plastic or metal. These materials allow easy cleaning and disinfection of the surface, which result in the maintenance of hygiene.

According to the present invention, the seat developed by the Applicants is a seat part of chairs, but in other embodiments it can also be mounted to benches with seats as stadium seats. In another embodiment, the seat with the above-described recesses in the upper surface can also be used for toilet seats.

Figure 6:
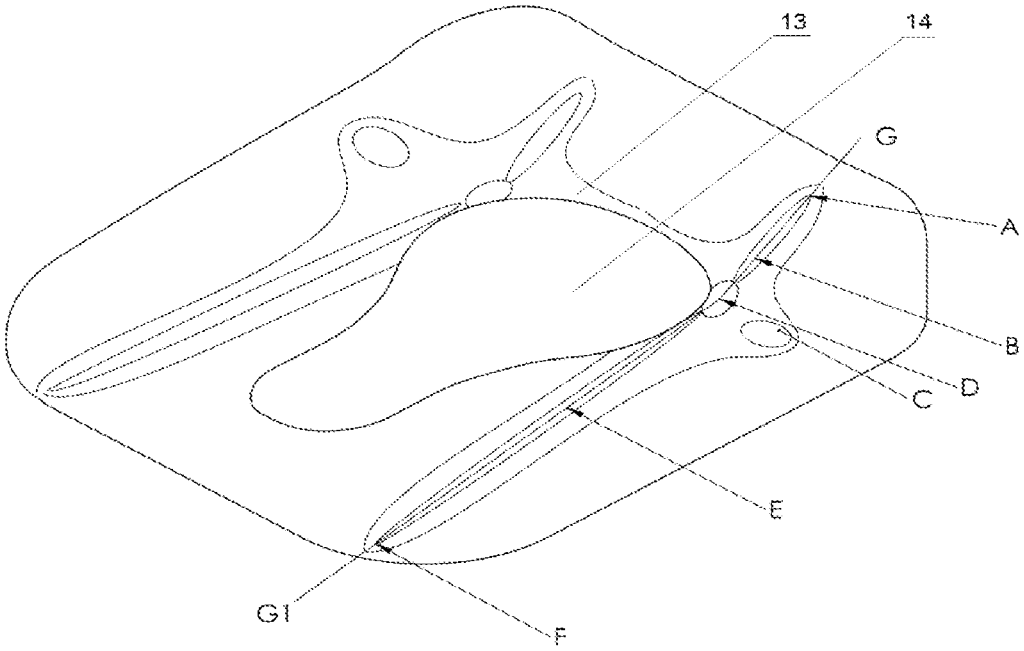
Figure 7:
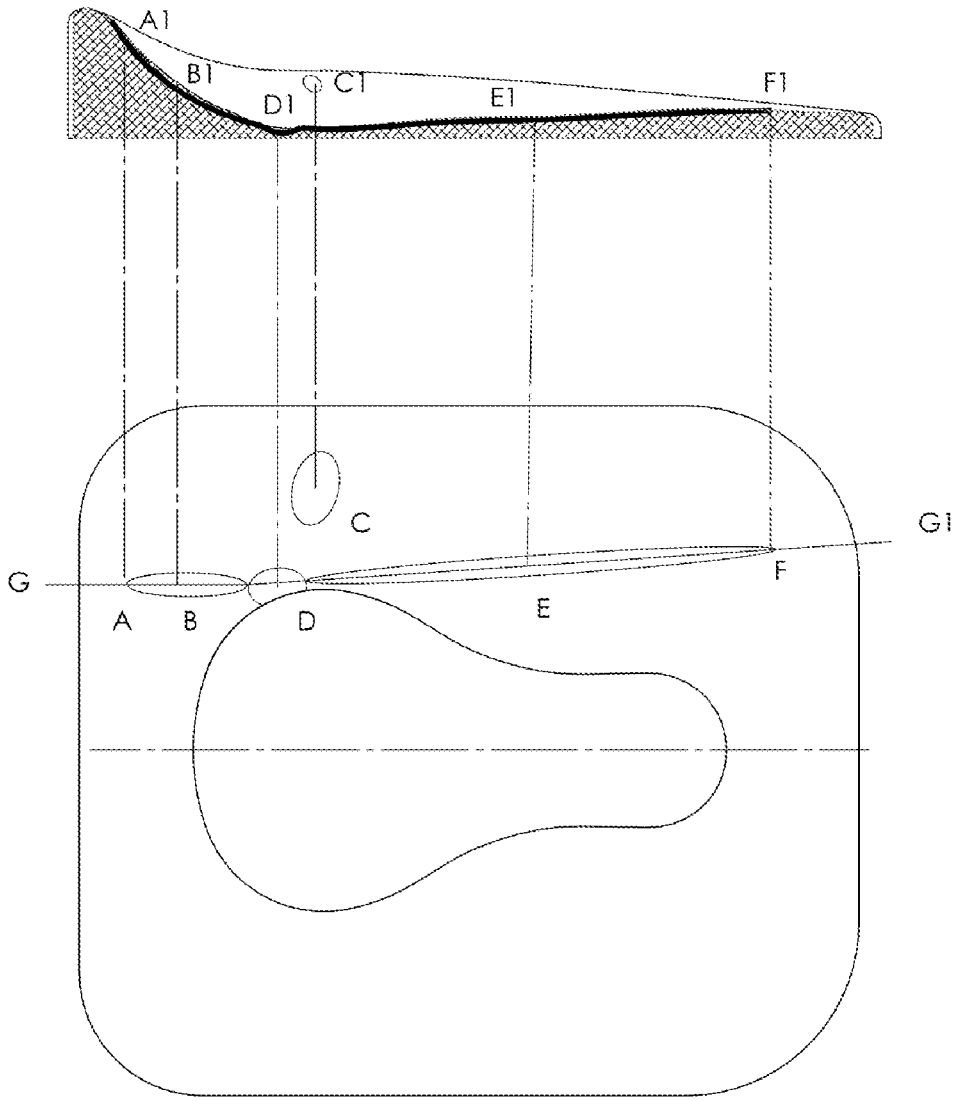

In the embodiment shown in FIG. 6 and FIG. 7, the seat is a toilet seat which has a centrally located pear-shaped opening. A wider pear-shaped part of the opening is situated at the rear part of the seat, and the edge of the opening overlaps the part of the central recess and the relief groove. In this embodiment, the opening 14 has a taper in the front part of the seat that extends over about 1/3 of the opening. Thanks to this shape of the opening, in the front part of the seat, widened side surfaces have been provided to ensure comfortable positioning of the user's thighs.

Combining the seat described in the above exemplary embodiments with an additional element in the form of a lumbar support enables an appropriate influence of these elements on the spine. Such a solution is another variant of the solution presented in FIG. 8 and FIG. 10. Due to the as-proposed shape, the lumbar support affects the most delicate connection in the spine, i.e. the L5S1 segment. The combination of the seat and the backrest according to the present invention is based on the principle of a closed kinematic chain. Supporting the pelvis and the lumbar section allows the muscles that have attachments to this anatomical part of the locomotor system to be used to build the appropriate shape of the upper spine. This applies mainly to the extensor muscles of the spine. Thanks to the appropriate shape of the seat and the lumbar support, the proper support of the pelvis and the lumbar spine is achieved, limiting the mobility of these parts, and thereby enabling the proper positioning of the thoracic and cervical sections. The shape of the seat and the lumbar support developed by the Inventors, including the convex lumbar support located in the recess, with the simultaneous side support for these muscles, engages the muscles connecting the pelvis with the thorax. Such stabilization guarantees the formation of the closed kinematic chain.

In the seats presented so far, the lumbar support causes the pelvis to slide forward and to rotate backwards, which are coexisting phenomena leading to kyphotization of this section of the locomotor system. As a result of such positioning of the pelvis, the thoracic kyphosis worsens while the cervical lordosis is abolished. This is a typical posture mistake, especially of young people, which is referred to as "round back". This very often leads to irreversible changes in the form of Scheuermann's disease.

Figure 8:
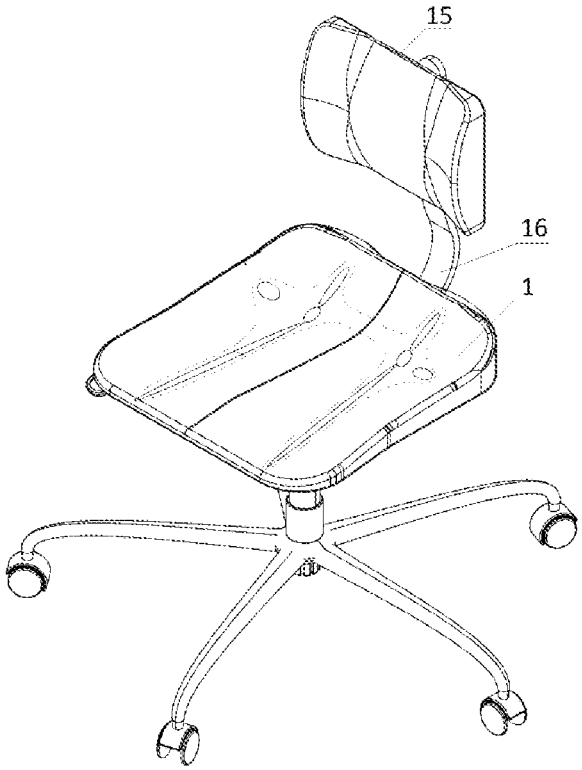
Figure 9:
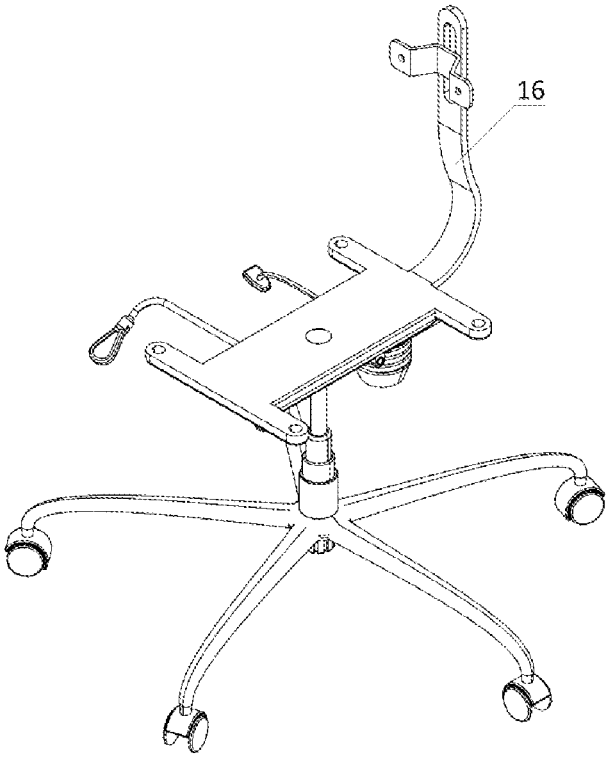
Figure 10:
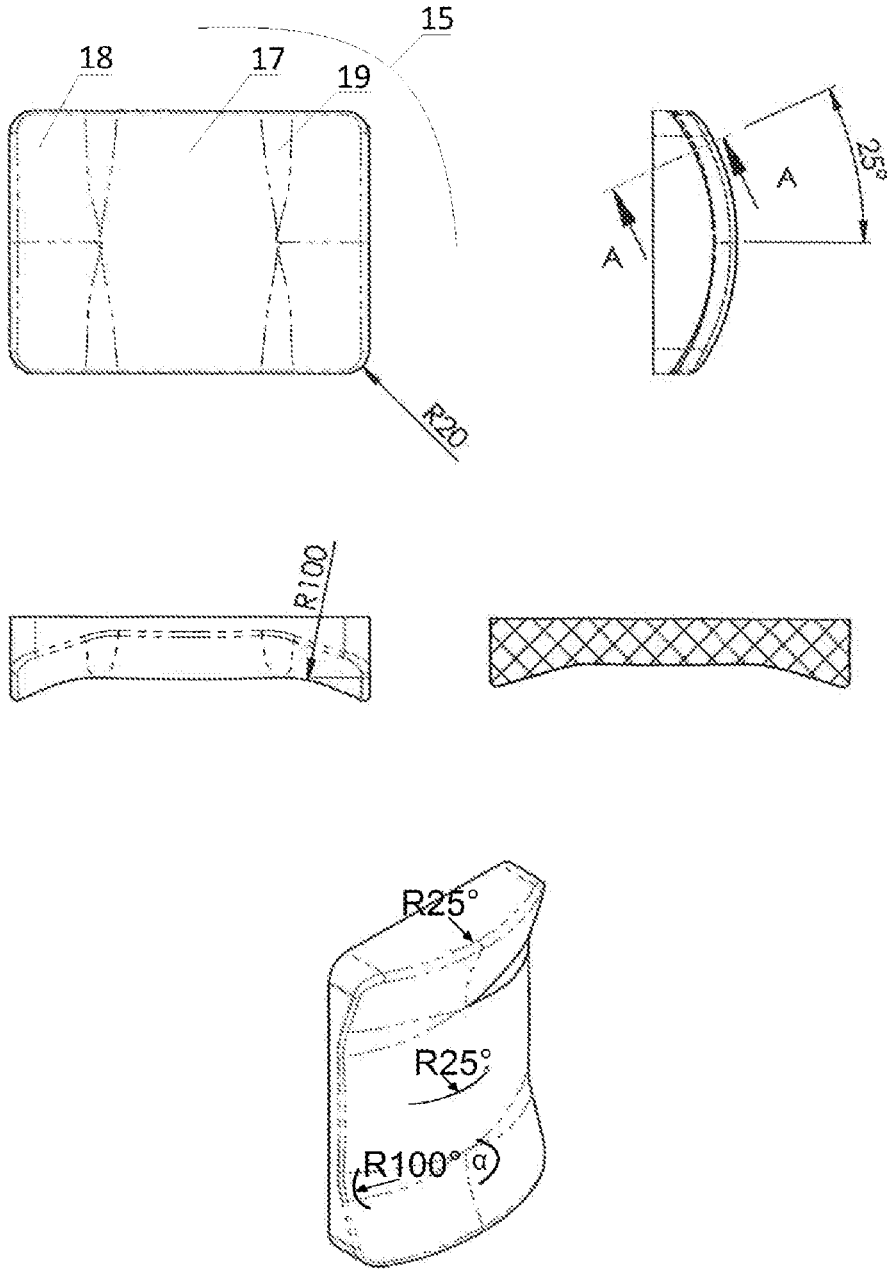

In another preferred embodiment shown in FIGS. 8-10, the seat is additionally provided with a lumbar support which is connected to the seat via a holder attached to the bottom surface of the seat and to the rear surface of the lumbar support. The lumbar support is an element having a substantially flat rectangular back and a profiled contact part that has a recessed central part and side surfaces obliquely situated in relation to the recessed central part, wherein the surface of the recessed central part and the obliquely situated side surfaces are convex, and between the recessed central part and the obliquely situated side surfaces, there are arranged concave triangular surfaces.

In this variant of the embodiment, apart from the part of the backrest supporting the lumbar lordosis of the spine, a new shape of the backrest surface was applied, in the form of triangular surfaces located between the lordosis supporting surface and the side surface stabilizing the person sitting on the seat. The function of these triangular surfaces is to relieve the part of the sitting person's skeletal system. The upper concave triangular surfaces are made to relieve the free ribs in their distal sections, while the lower concave triangular surfaces are made to relieve the posterior superior iliac spines.

Preferably, when the profiled contact part of the lumbar support is bulged along its longer symmetry axis along the radius R 25°, the profiled recessed central part is half the width of the lumbar support, and the remaining width of the backrest is formed by two obliquely situated side surfaces. Along the side edges of the profiled recessed central part in the direction of the longer axis, there are substantially triangular recesses with a radius R 100° and a width at the base of the triangle in the range of 15-25 mm, preferably 20 mm, the apices of which meet at the height of the longer axis of symmetry. The profiled side surfaces extend from the edge of the concave triangular surfaces towards the outer side edge of the lumbar support, and their inclination angle $\alpha$ is in the range of 20-30°, preferably 24°, and the length of these side surfaces is in the range of 55-75 mm, preferably 65 mm.

Additional Marks:

A—the starting point of the rear recess under the ramus of the ischial bone in the seat B—the rear recess under the ramus of the ischial bone in the seat C—the side recess for the trochanter of the femur in the seat D—the central point of the central recess for the ischial tuberosity in the seat E—the central part of the front recess that relieves the sciatic nerve in the seat F—the ending point of the front recess that relieves the sciatic nerve in the seat G-D-G1—the line connecting the recesses that extend along the seat in the seat Z-D—the line connecting the centre of the central recess for the ischial tuberosity with the ending point of the front recess that relieves the sciatic nerve in the seat Y-C—the line connecting the side recess for the trochanter of the femur with the ending point of the front recess that relieves the sciatic nerve in the seat

The invention claimed is:

1. A seat having a profiled upper surface with recesses and inclinations of a part of the upper surface, wherein the upper surface of the seat is variously shaped such that from a rear edge, said upper surface is inclined downwards, following an arc, towards a front edge of the seat, and the upper surface has rear recesses, central recesses, front recesses, and the side recesses arranged thereon, symmetrically in relation to the longitudinal symmetry axis of the seat, where all of which are located within a profiled ergonomic niche with a shape similar to the letter H, while a transverse arm of the profiled ergonomic niche connects longitudinal arms of the profiled ergonomic niche forming a relief groove, while the rear recesses, central recesses, and front recesses have different lengths and depths, and have an ellipsoidal shape; and are arranged one after the other along a longitudinal arm of the profiled ergonomic niche, and side recesses are arranged between the central recesses and front recesses and side edges of the seat.

2. The seat according to claim 1, wherein the rear recesses, central recesses, and front recesses are situated at angles in relation to a longitudinal symmetry axis of the seat, wherein the central recesses are deeper than the front recesses, and wherein an angle of the front recesses increases towards the front edge of the seat.

3. The seat according to claim 1, wherein the upper surface of the seat, from the rear recesses, central recesses, and front recesses towards the side edges, forms bulges which decrease in height from the side of the rear edge of the seat towards the front edge of the seat; and in a front part from the side of the front edge, the seat surface is flat.

4. The seat according to claim 1, wherein the side recesses are located on bulges of the upper surface of the seat, which are situated approximately halfway across the bulges, between the side edges and a longitudinal arm of the profiled ergonomic niche.

5. The seat according to claim 1, wherein the side recesses have longer axes arranged at an angle in relation to longitudinal arms of the profiled ergonomic niche.

6. The seat according to claim 1, wherein the rear recesses and the central recesses, from the side of the rear edge of the seat to a central point of each of the central recesses, are situated at an angle in a range of 8-14 degrees, optionally 12 degrees, and wherein the central recesses and the front recesses, from the central point of each of the central recesses through the front recesses towards the front edge of the seat, the central recesses and the front recesses are situated at an angle in the range of 16-20 degrees, optionally 18 degrees.

7. The seat according to claim 1, wherein centers of the central recesses are deepest at approximately ⅓ of a length of the seat from a rear edge of the seat thereof, respectively.

8. The seat according to claim 1, wherein the side recesses are situated at approximately ⅖ of a length of the seat from a rear edge of the seat thereof and at approximately 1/10 of a width of the seat from a side edge of the seat thereof, respectively.

9. The seat according to claim 1, wherein the rear recesses, central recesses, front recesses, and side recesses are arranged such that drawing a line through the central recess and a farthest point towards the front edge of the seat of the front recess forms an ascending line, and drawing a line through the side recess and a farthest point towards the front edge of the seat of the front recess forms a descending line; the lines intersect to form an X.

10. The seat according to claim 1, wherein said seat is a seat part of at least one of chairs, benches with seats, stadium seats, or said seat is a toilet seat.

11. The seat according to claim 1, wherein said seat has a centrally located pear shaped opening which has a taper in a front part of the seat.

12. The seat according to claim 11, wherein an edge of an opening overlaps a part of the central recess and the relief groove.

13. The seat according to claim 1, wherein said seat further comprises a lumbar support which is connected to the sea via a bracket attached to a bottom surface of the seat and to a rear surface of the lumbar support; the lumbar support is an element with a substantially flat rectangular back and a profiled contact part that has a recessed central part and side surfaces obliquely situated in relation to the recessed central part; wherein a surface of the recessed central part and obliquely situated side surfaces are convex, and between the recessed central part and the obliquely situated side surfaces, there are arranged concave triangular surfaces.

14. The seat according to claim 13, wherein the profiled contact part of the lumbar support along a longer symmetry axis thereof is bulged along a radius R 25°; a profiled recessed central part is substantially half the width of the lumbar support, and a remaining width of a backrest is formed by two obliquely situated side surfaces, where along side edges of the profiled recessed central part in a direction of a longer axis, there are arranged concave triangular surfaces with a radius of R 100° and a width at the base of a triangle in a range of 15-25 mm, optionally 20 mm, the apices of which meet at half of a height of a backrest at a height of an longer axis of symmetry, and profiled side surfaces extend from an edge of concave triangular surfaces towards an outer side edge of the lumbar support, and an inclination angle $\alpha$ thereof is in a range of 20-30°, optionally 24°, and a length of said side surfaces is optionally in a range of 55-75 mm, optionally 65 mm.

15. The seat according to claim 1, wherein said seat is made of one or more materials that are easy to disinfect, optionally of wood-based materials, plastics or metal.

* * * * *